United States Patent [19]

Norton

[11] 4,422,412

[45] Dec. 27, 1983

[54] DEVICE FOR CONVERTING ALCOHOLS TO ETHERS

[75] Inventor: John H. R. Norton, Johannesburg, South Africa

[73] Assignee: AECI Limited, Johannesburg, South Africa

[21] Appl. No.: 442,001

[22] Filed: Nov. 16, 1982

Related U.S. Application Data

[63] Continuation of Ser. No. 214,794, Dec. 9, 1980, abandoned.

[30] Foreign Application Priority Data

Dec. 27, 1979 [ZA] South Africa ..... 79/7031

[51] Int. Cl.[3] ..... F02M 27/02

[52] U.S. Cl. ..... 123/3

[58] Field of Search ..... 123/1 A, 3; 48/197 FM; 44/77

[56] References Cited

U.S. PATENT DOCUMENTS

| | | | |
|---|---|---|---|
| 2,513,769 | 7/1950 | White | 48/197 FM |
| 2,876,750 | 3/1959 | Carr | 123/1 A |
| 3,660,059 | 5/1972 | Hollemann et al. | 48/197 FM |
| 3,849,082 | 11/1974 | Kozlowski et al. | 44/77 |
| 3,963,000 | 6/1976 | Kosaka et al. | 123/1 A |
| 3,986,350 | 10/1976 | Schmidt | 123/3 |
| 4,156,698 | 5/1979 | Dwyer et al. | 585/408 |
| 4,175,210 | 11/1979 | Selwitz et al. | 568/579 |
| 4,282,835 | 8/1981 | Peterson et al. | 123/1 A |

FOREIGN PATENT DOCUMENTS

| | | | |
|---|---|---|---|
| 19340 | 11/1980 | European Pat. Off. . | |
| 365115 | 2/1922 | Fed. Rep. of Germany . | |
| 2818831 | 5/1982 | Fed. Rep. of Germany . | |
| 1513051 | 6/1978 | United Kingdom | 123/1 A |

*Primary Examiner*—William A. Cuchlinski, Jr.

*Attorney, Agent, or Firm*—Cushman, Darby & Cushman

[57] ABSTRACT

The invention concerns the modification of a compression ignition engine by providing a device which converts an alcohol to an ether. The device comprises a heat exchanger having an inlet to receive the alcohol and an outlet in communication with the inlet end of a catalytic conversion chamber, said catalytic conversion chamber containing a catalyst capable of converting an alcohol to an ether and having an outlet pipe for leading the ether to a cylinder of the compression ignition engine, and mounting means adapted to enable the device to be fitted to a suitable part of the compression ignition engine.

2 Claims, 7 Drawing Figures

DEVICE FOR CONVERTING ALCOHOLS TO ETHERS

This is a continuation of application Ser. No. 214,794, filed Dec. 9, 1980 now abandoned.

THIS INVENTION relates to a device for converting alcohols to ethers.

The present invention provides a device for converting an alcohol to an ether when fitted to a compression ignition engine, said device comprising a heat exchanger having an inlet to receive the alcohol and an outlet in communication with the inlet end of a catalytic conversion chamber, the catalytic conversion chamber containing a catalyst capable of converting an alcohol to an ether and having an outlet pipe capable of leading the ether to a cylinder of the compression ignition engine, and mounting means adapted to enable the device to be fitted to a suitable part of the compression ignition engine.

The invention further comprises the combination of a compression ignition engine comprising at least one cylinder having at least one inlet and an outlet, a device as described above mounted on a suitable part of the engine with the outlet pipe from the catalytic convertion chamber leading to an inlet into the cylinder.

The alcohol may be provided in an alcohol supply tank. Conveniently, the pipe leads from the alcohol supply tank through a fuel injection pump to a junction piece with one outlet from the junction piece leading to the inlet of the heat exchanger and the other outlet from the junction piece being a pipe capable of leading to the cylinder. The outlet from the junction piece which leads to the heat exchanger conveniently leads through a partial vaporiser upstream of the inlet of the heat exchanger.

If the heat exchanger is a boiler/superheater, the alcohol supply pipe may lead to a pump and then to the boiler/superheater. The pipe which leads alcohol to the cylinder conveniently includes a fuel injection pump. A lubricant storage tank and pipe therefrom to the alcohol pipe can then be positioned upstream of the fuel injection pump.

The alcohol conveniently is methanol. Preferably, a major proportion of the methanol is directed into the cylinder and a minor proportion is directed through the device provided by the invention to convert it partially into dimethyl ether which is also passed into the cylinder.

We have found that a mixture of methanol and dimethyl ether is a suitable fuel for running compression ignition engines, sometimes known as 'diesel engines'. With the present invention, a single methanol tank can be utilised to supply the methanol part of the fuel and also the dimethyl ether part of the fuel. We have found it convenient to incorporate a lubricant, for example, castor oil, in such fuels. In order to reduce the destructive action of such castor oil on the converter catalyst, a partial vaporiser may be incorporated in the pipe upstream of the converter with a view to vaporising only the methanol and not the castor oil in the stream leading to the heat exchanger. The caster oil will then, at least partially, pass along the pipe containing the methanol which is not converted to dimethyl ether. The heat required to vaporise the methanol may be provided by heat from the exhaust gases or by hot water from the engine cooling system.

The amount of methanol to be converted to dimethyl ether can be adjusted, e.g. by adjusting valves, the diameters of the pipes being used, etc. Conveniently, up to about 50%, e.g. about 5 to 30% of the mixture injected into the cylinder, may comprise dimethyl ether.

The device provided by the invention has mounting means for enabling it to be attached to a suitable part of the compression ignition engine, conveniently at a place adjacent to the cylinder. For example, the heat exchanger may be provided with mounting means shaped to fit in or around an exhaust pipe from the cylinder. The mounting means may comprise bolts. A mounting around the exhaust pipe has the advantage that heat from the exhaust can be used in the heat exchanger. Additional heat may be required for the conversion catalyst. This heat may be provided by the exhaust pipe from the cylinder and/or by means of an electrical heating device provided to the conversion catalyst.

The methanol may be injected into the cylinder through the air inlet or may be injected through a separate inlet to the cylinder. The dimethyl ether formed may be injected into the cylinder through the air inlet, or it may be injected admixed already (and at least partially dissolved within) the methanol through the methanol inlet. Alternatively, the dimethyl ether may be injected into the cylinder through a separate inlet from the air and the methanol.

The device provided by the invention enables a compression ignition engine to run smoothly and continuously from a single source of fuel but utilising, as the fuel which actually enters the cylinder, at least two different chemical compounds. When starting from cold, an electrical heating system to the catalytic converter can be used, or diesel fuel itself may be utilised. The methanol and dimethyl ether fuel may be supplied with diesel fuel to the cylinder or without any diesel fuel. The methanol to be converted may be heated by means of a separate burner which would burn methanol drawn from the methanol tank.

The device may be used as a kit to modify existing engines, or may be supplied as a unit with a new engine.

The invention also provides a method of modifying a compression ignition engine, which comprises mounting on a suitable part thereof, a device comprising a heat exchanger having an inlet to receive an alcohol and an outlet in communication with the inlet end of a catalytic conversion chamber capable of converting an alcohol to an ether, and leading an outlet pipe from the catalytic conversion chamber into a cylinder of the compression ignition engine.

The modification may comprise the further step of connecting a pipe from an alcohol supply tank to the inlet of the heat exchanger and leading a further pipe from the alcohol supply into communication with the cylinder without passing through the catalytic conversion chamber.

Any suitable catalyst capable of converting an alcohol to an ether can be used in the catalyst converter. Examples are alumina, potassium alum, silica gel and various aluminosilicates. The use of active alumina which has been modified by deposition of silica, is a good selective catalyst.

The invention also provides the method of running a compression ignition engine, which comprises supplying an alcohol from a supply tank through a first pipe to a cylinder of the engine and through a second pipe to a heat exchanger, supplying the alcohol from the heat exchanger to a catalytic conversion chamber containing a catalyst capable of converting the alcohol to an ether and leading the ether formed to the cylinder.

The weight hourly space velocity of the fuel over the catalyst generally is greater than 0,2 $(hour)^{-1}$ and may be in excess of 1 $(hour)^{-1}$ or even about 50 $(hour)^{-1}$. Usually less than 7 kg of catalyst per cylinder, for example from 0,05 to about 3,5 kg is sufficient.

The temperature in the catalytic converter can be in the range of about 80° to 400° C. More usually, the temperature is in the region of 250° to 350° C.

The invention is illustrated schematically in nonlimiting manner by reference to the accompanying drawings, in which FIG. 1 is a schematic drawing of one embodiment of the invention;

Figure 1:
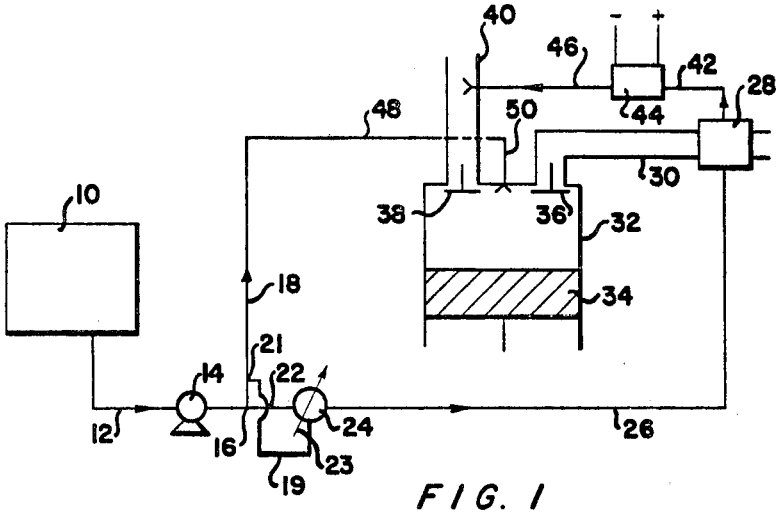
Figure 2:
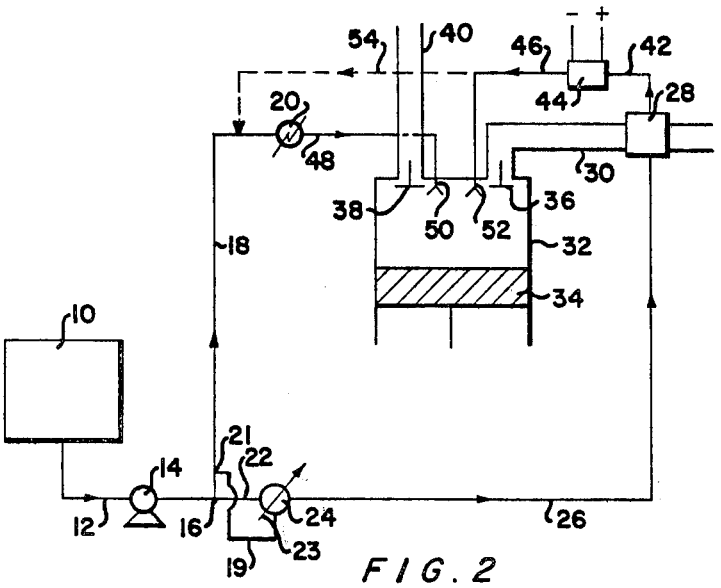
FIG. 2 is a schematic drawing showing two further embodiments of the invention.

In FIGS. 1 and 2, parts which are the same have the same numeral. Thus, methanol from a methanol storage tank 10 passes along pipe 12 to a fuel injection pump 14 which leads to a junction piece 16. One line from the junction piece (the major line) passes along pipe 18. The other line from the junction piece passes along pipe 22 to a partial vaporiser 24 where some of the methanol will be vaporised. Any castor oil lubricant present together with unvaporised methanol, will pass along line 19 and connect via junction 21 with the remainder of the methanol in line 18. The heat required for vaporising the methanol is supplied by the hot water in the engine cooling system via line 23.

The vaporised methanol passes from the vaporiser 24 along pipe 26 to a heat exchanger 28 mounted in or around exhaust pipe 30 leading from a compression ignition cylinder 32. The cylinder has a piston 34, valve 36 in the exhaust port, and valve 38 in the inlet port of air inlet 40.

The methanol is heated in the heat exchanger 28 and passes along pipe 42 to a catalytic converter 44 where the methanol is partially converted to dimethyl ether and passed into pipe 46. The catalyst is a silica modified active alumina catalyst.

In the embodiment of FIG. 1, the dimethyl ether from pipe 46 enters the air inlet 40 and hence the cylinder 32 with the air. Meanwhile, in that Figure, the methanol passes from the junction 21 through pipes 18 and 48 to enter the cylinder through a separate inlet 50.

Referring now to FIG. 2, the methanol from the junction 21 passes through a cooler 20, then along pipe 48 to enter the cylinder through inlet 50. On the other hand, in the scheme shown in unbroken lines, the dimethyl ether from the catalytic converter 44 passes along pipe 46 to enter the cylinder 32 through a separate inlet 52.

In the alternative embodiment also shown in FIG. 2, and instead of entering the cylinder through inlet 52, the dimethyl ether may pass along pipe 54 shown in broken lines to be mixed with the methanol upstream of the cooler 20 and enter the cylinder through inlet 50 dissolved in the methanol.

Figure 3:
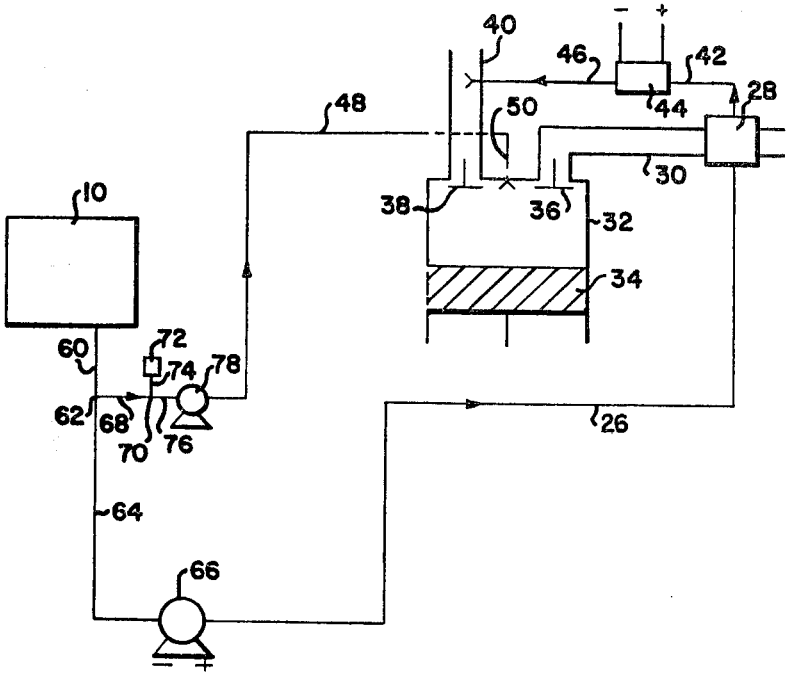
FIG. 3 is a schematic drawing of a fourth embodiment of the invention.
Figure 4:
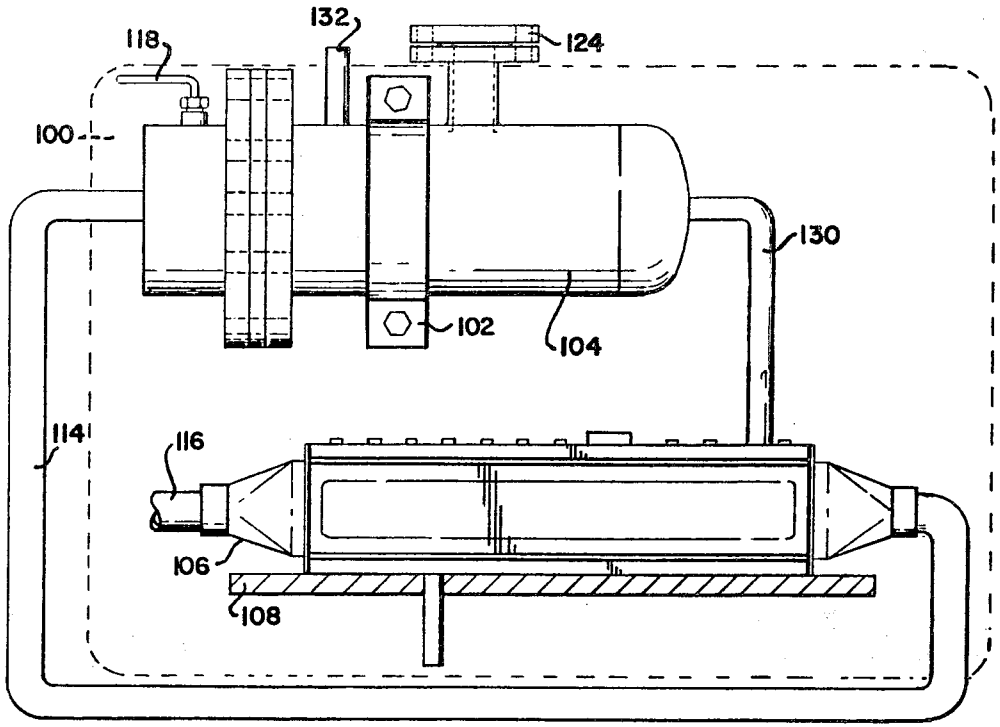
FIG. 4 is a side elevation of an engine with the device of the invention mounted thereon.
Figure 5:
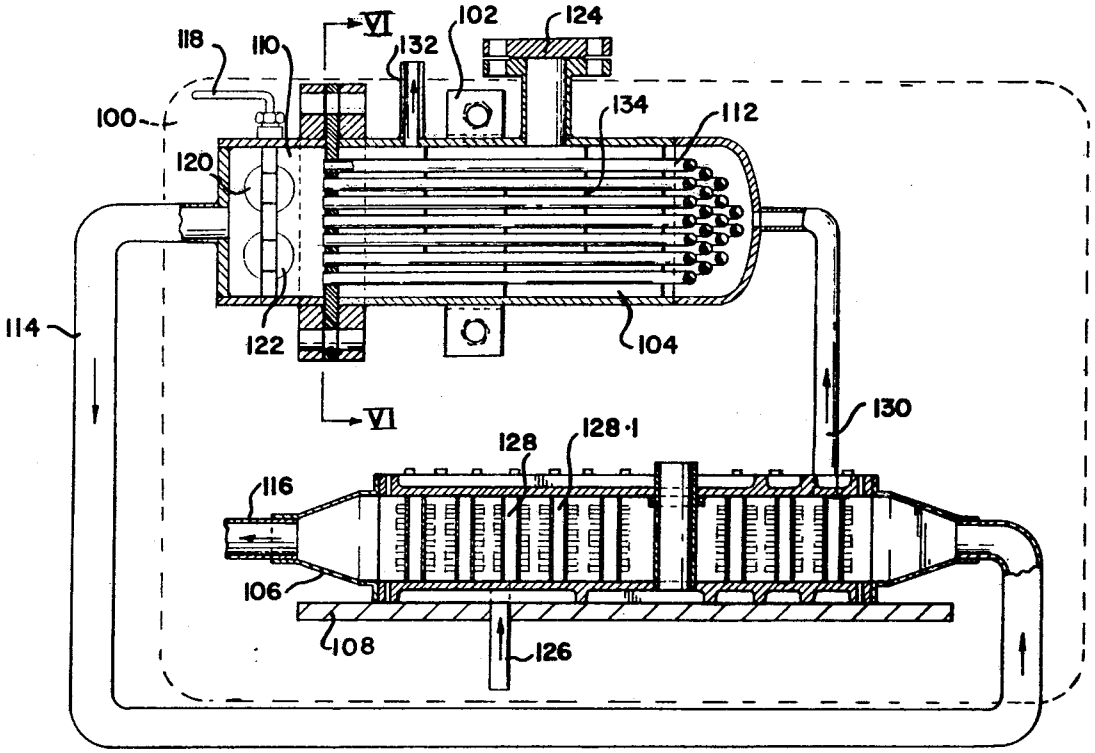
FIG. 5 is a longitudinal cross-sectional view of the device illustrated in FIG. 4.
Figure 6:
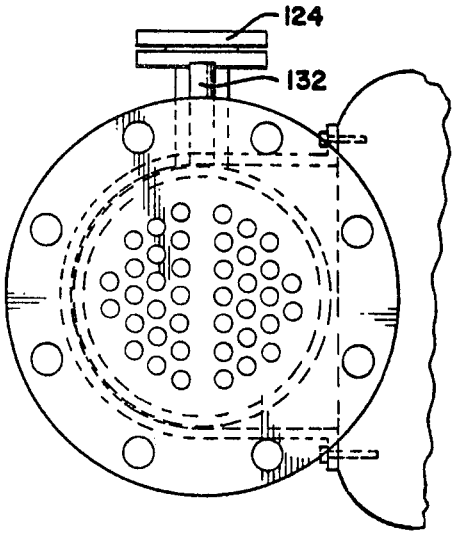
FIG. 6 is a section along VI—VI of FIG. 5.
Figure 7:
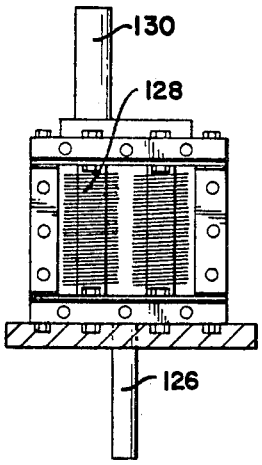
FIG. 7 is a section along VII—VII of FIG. 5.

As a further embodiment of the invention, reference is made to FIG. 3, in which parts which are identical with FIG. 1, have the same numerals as in FIG. 1.

Methanol from a methanol storage tank 10 passes along pipe 60 to junction piece 62. Pipe 64 from junction piece 62 leads to the electrically driven pump 66. Pump 66 delivers methanol via pipe 26 to a heat exchanger 28 (in the form of a boiler/superheater), mounted in or around exhaust pipe 30, leading from a compression ignition cylinder 32. The cylinder has a piston 34, valve 36 in the exhaust port, and valve 38 in the inlet port 40 for air inlet.

The methanol is heated in the boiler/superheater 28 and passes along pipe 42 to a catalytic converter 44, where the methanol is partially converted to dimethylether and passed into pipe 46. Pipe 46 is connected to the air inlet 40 such that the dimethylether stream passes with the air through valve 38 into the cylinder 32. The catalyst in 44 is gamma-alumina.

Pipe 68 from junction piece 62 connects to junction piece 70. An automatic lubricant injection unit injects lubricant from lubricant storage tank 72, through pipe 74, into one side of junction piece 70. The methanol and lubricant pass through pipe 76 to a fuel injection pump 78 which leads through pipe 48 to enter the cylinder 32 through a separate inlet 50.

In this embodiment, the weight hourly space velocity of methanol over the catalyst is greater than 0,2 $(hour)^{-1}$ and in particular can be as high as 50 $(\mathbf{hour})^{-1}$. Generally, the mass of catalyst is less than 7 kg of catalyst per cylinder; in particular 0,05 kg to 0,15 kg of catalyst can be used per liter of engine capacity. The proportion of methanol fed to the engine via the catalytic converter can be from 5% to 50% of the total methanol flow rate to the engine.

In FIGS. 4 to 7, a compression ignition engine is shown schematically in broken lines at 100. Mounted on the side thereof by a support bracket 102 is a catalyst conversion chamber 104. A boiler/superheater 106 is bolted on the side of the engine 100 by a support plate 108.

Exhaust gas from the engine passes through a pipe (not visible) into chamber 110 and then into U-tubes 112. It passes out along pipe 114 into the centre of the boiler/superheater 106 before finally leading into exhaust pipe 116. A handle 118 operates baffles 120, 122 for controlling the volume of exhaust gas passing down the U-tubes 112.

A catalyst is inserted into the chamber 104 through hatch 124. Liquid methanol from a storage tank (not shown) enters the boiler/superheater 106 through inlet 126, passes through finned tubes 128,128.1, and leaves the boiler/superheater 106 as vapour through outlet 130. From here the methanol vapour passes through the catalyst which is heated by the U-tubes 112. Conversion of the methanol to dimethyl ether takes place and the dimethyl ether leaves the conversion chamber through pipe 132 which leads to the engine. Baffles are shown at 134.

I claim:

1. A compression ignition engine capable of running on a fuel of methanol and dimethyl ether, said engine comprising a compression ignition engine having at least one cylinder, a heat exchanger mounted by mounting means on the compression ignition engine, said heat exchanger being adapted to heat methanol passing therethrough to a temperature in the range of 80° to 400° C., a conversion chamber containing a catalyst for converting methanol to dimethyl ether at a temperature in the range of 80° to 400° C., also mounted by mounting means on the compression ignition engine, a supply tank for methanol, a first pipeline to lead a stream of methanol from the supply tank to the cylinder, a second pipeline to lead a stream of the methanol from the supply tank to the heat exchanger, a pipe for the methanol vapour leading from the heat exchanger to the conversion chamber, and a pipe for the dimethyl ether leading from the conversion chamber to the cylinder.

2. A method of running a compression ignition engine on methanol and dimethyl ether, which comprises supplying a first part of methanol fuel from a supply tank containing the methanol fuel through a first pipe to a cylinder of the engine, and supplying a second part of the methanol from the supply tank through a second pipe to a heat exchanger where it is heated to a temperature in the range of 80° to 400° C., supplying this second part of the methanol at a temperature in this range from the heat exchanger to a catalytic conversion chamber containing a catalyst capable of converting the methanol to dimethyl ether at a temperature in the range of 80° to 400° C. and leading the dimethyl ether formed directly to the cylinder.

* * * * *